United States Patent [19]

Schoch et al.

[11] 4,354,948

[45] Oct. 19, 1982

[54] LUBRICATING VARNISHES HAVING A GRAPHITE FLUORIDE BASE AND METHOD OF PREPARING SAME

[75] Inventors: Elisabeth Schoch, Sonchamp; Michel Rebiffe, Houilles, both of France

[73] Assignee: PCUK Produits Chimiques Ugine Kuhlmann, Courbevoie, France

[21] Appl. No.: 197,944

[22] Filed: Oct. 17, 1980

[30] Foreign Application Priority Data

Nov. 13, 1979 [FR] France ..... 79 27887

[51] Int. Cl.[3] ..... C10M 7/04

[52] U.S. Cl. ..... 252/22; 252/29; 252/49.5

[58] Field of Search ..... 252/22, 23, 29, 49.5

[56] References Cited

U.S. PATENT DOCUMENTS

| | | | |
|---|---|---|---|
| 905,649 | 12/1908 | Chapman | 252/29 |
| 2,083,176 | 6/1937 | Wilson | 252/29 X |
| 2,176,879 | 10/1939 | Bartell | 252/29 X |
| 3,071,543 | 1/1963 | McGee | 252/29 X |
| 3,341,454 | 9/1967 | Chor, Jr. et al. | 252/23 X |
| 3,607,747 | 9/1971 | Ishikawa et al. | 252/29 X |
| 3,856,686 | 12/1974 | Sato et al. | 252/29 X |

FOREIGN PATENT DOCUMENTS

| | | | |
|---|---|---|---|
| 499584 | 1/1954 | Canada | 252/29 |
| 54-125366 | 9/1979 | Japan | 252/29 |

*Primary Examiner*—Andrew Metz

*Attorney, Agent, or Firm*—Pennie & Edmonds

[57] ABSTRACT

Lubricating varnishes for metals obtained by mixing a dispersion of graphite fluoride in glycerine with a separately prepared aqueous dispersion of graphite fluoride, stabilized by a salt of a condensate of naphthalene sulfonic acid with formol.

9 Claims, No Drawings

LUBRICATING VARNISHES HAVING A GRAPHITE FLUORIDE BASE AND METHOD OF PREPARING SAME

TECHNICAL FIELD

The invention is concerned with lubricating varnish compositions comprising water, glycerine and a graphite fluoride base.

BACKGROUND OF THE INVENTION

Solid lubricants, such as molybdenum bisulfide, graphite and graphite fluoride, are only rarely applied in the dry powder state on the surfaces to be lubricated. More often they are used in the form of dispersions in oil, in organic solvents or in water, or even in the form of grease or paste. On numerous metallic pieces it is even more advantageous to deposit a lubricating varnish which adheres to metal.

It is known to form varnishes having a molybdenum bisulfide base and heat-hardening binders, such as corn syrups, silicones, asphalts and glycerine. In particular, such varnishes are described in the publications of NACA (National Advisory Committee for Aeronautics), Technical Note 2628 of February 1952 and Technical Note 2802 of October 1952.

The adherence of these varnishes to metallic surfaces depends on many factors such as the roughness of the metallic surface to be treated (which is a function of the method of burnishing, thus grinding gives roughnesses of between about 0.1 to 0.4 micrometers (μm) while with sandblasting it is difficult to obtain a roughness below 1 μm; the particle size of the solid lubricant which can vary from 10 μm to less than 1 μm, depending on the method of preparation and grinding used; and the nature of the metallic surface to be lubricated (for example, steel, brass, cast aluminum, tungsten carbide, zamak - a zinc alloy, etc.)

When one wants to prepare lubricating varnishes with a graphite fluoride base by relying on the teachings of the prior art, one encounters numerous difficulties. The varnishes, containing 2 parts by weight of glycerine and 1 part by weight of graphite fluoride (with a ratio of F/C=x=0.9) with an average 1 μm particle size, adhere firmly, after heating at 250° C. on steel pieces and on steel alloys of chrome and chrome-manganese. But on stainless steel there is less adherence. This is also true of metals other than steel. This bad adherence occurs on the one hand from the nature of the metal and, on the other hand, from the fact that the mixture of glycerine and graphite fluoride is relatively pastey and gives films that are too thick. If one tries to dilute this mixture by water to make it less viscous, one obtains a varnish which decants rapidly and which, consequently, is difficult to store. Moreover, the adherence on metals is very inadequate.

Aqueous dispersions of graphite fluoride can be prepared by grinding, for example, 20 parts by weight of 5 μm particle size graphite fluoride in the presence of 70 parts by weight of water and 10 parts by weight of the sodium salt of a condensate of naphthalene sulfonic acid and formol (an aqueous dispersion of formaldehyde) marketed by PCUK Produits Chimiques Ugine Kuhlmann under the trademark DISPERGINE CB. The final particle size of graphite fluoride in the dispersion is advantageously approximately 1 μm.

When such a dispersion is sprayed alone on ferrous metals and on aluminum, it gives, after heating at 250° C., a uniform film which is not very lubricating and which is not resistant to the action of water. Dripping water on a steel plate coated with such a film causes rapid scaling and non-adherence of the film.

If glycerine is incorporated in the aqueous dispersion of graphite fluoride so that the graphite fluoride/glycerine ratio is equal to 0.4, and this composition is sprayed on aluminum or steel, a very irregular and barely adhering film is obtained after heating.

If, on the other hand, graphite fluoride powder, glycerine and an aqueous solution of DISPERGINE CB are mixed directly, compositions are obtained which, when applied on aluminum and dried at 250° C., yield adhering varnishes, but which do not pass the dripping water test.

DETAILED DESCRIPTION OF THE INVENTION

This invention, totally unexpectedly, comprises the discovery that by first preparing a mixture of glycerine and graphite fluoride powder, and by adding to this mixture an aqueous dispersion of graphite fluoride stabilized with DISPERGINE CB (as herein above defined), compositions are obtained which, after drying one hour at 250° C., form brilliant varnishes, adhering very firmly to all types of metals and being perfectly resistant to the dripping water test. These compositions are very easy to apply by spraying and yield very thin films of 4 to 5 μm thickness, with great lubricating power.

The particle size of the solid lubricant should be closely connected to the roughness of the metallic surface. The lower the roughness, the finer the particle size of the solid lubricant should be to obtain a good adherence of the varnish on the metal.

The graphite fluorides are solid lubricants which have numerous advantages over molybdenum bisulfide. They have the general formula $(CF_x)_n$, where x can vary between about 0.8 and 1.2 and n is indeterminate. Graphite fluoride or fluorinated graphite is well known as are methods of its preparation. See, for example, THE JOURNAL OF PHYSICAL CHEMISTRY, Vol. 69, No. 8, August 1965, pages 2772–2775, "Kinetics of the Reactions of Elemental Fluorine, IV, Fluorination of Graphite", and British Patent No. 1,049,582, filed January 31, 1964.

In the compositions in this invention, the choice of a heat-hardening binder is critical. If, instead of glycerine, corn syrup, such as "molasses spread", is used, a sort of non-spreading and non-spraying grease is obtained. The choice of dispersant, used as a stabilizer, for the aqueous dispersion of graphite fluoride is also critical. If DISPERGINE CB is replaced by OLOA 246 B (trademark filed by the OROGIL Company for Calcium sulfonate) or by PLURONIC P 103 or F 88 (trademarks of PCUK Produits Chimiques Ugine Kuhlmann for sequenced condensates of propylene oxide and ethylene oxide), varnishes are obtained that have no adherence on aluminum.

In addition, the graphite fluoride/glycerine ratio can vary from 0.3 to 1, but preferably from 0.5 to 0.8.

The following examples illustrate the invention, although it is not limited to them.

EXAMPLE 1

(A) 100 parts by weight of graphite fluoride $(CF_x)_n$, with x=0.9, of 1 μm particle size, are thoroughly mixed with 200 parts by weight of glycerine.

(B) In addition, 100 parts by weight of an aqueous dispersion of graphite fluoride is prepared by grinding 20 parts by weight of graphite fluoride in the presence of 70 parts by weight of water and 100 parts by weight of powdered DISPERGINE CB stabilizer.

(C) To 50 parts of mixture A are added 50 parts of dispersion B and it is homogenized. The resulting lubricating composition obtained has a graphite fluoride/glycerine ratio equal to 0.80 (Composition I).

(D) To 62 parts of mixture A are added 38 parts of dispersion B and it is homogenized. The resulting lubricating composition obtained has a graphite fluoride/glycerine ratio equal to 0.68 (Composition II).

EXAMPLE 2

Compositions I and II of Example I are sprayed on plates of ordinary steel, stainless steel and aluminum of various degrees of burnishing, in such a way as to obtain, after heating one hour at 250° C., varnishes with a thickness of 4 to 5 μm. In all cases, the adherence of the varnish to the metal is considered as good to very good, and the film formed on the surface of the metal is resistant to dripping water.

EXAMPLE 3

The lubricating ability of compositions I and II in Example 1 is measured by a ball-disk apparatus which registers the friction coefficient as a function of the temperature. A steel XC 38 disc is polished to the desired roughness and coated with the product to be tested. This disc, turning at a constant speed, is submitted to pressure from a fixed steel 100 C 6 ball. For comparison, the lubricating ability of a simple 2/1 mixture of glycerine and graphite fluoride (A in Example 1) and the lubricating ability of an aqueous dispersion of graphite fluoride (B in Example 1) were measured under the same conditions. The results obtained are shown in Table 1.

TABLE 1

Disc Roughness: 0.1 to 0.2 μm
Sliding Speed: 0.15 cm/s
Charge Applied: 1 daN

| Friction Coefficient/ Temperatures °C. | Composition I | Composition II | Mixture A | Dispersion B |
|---|---|---|---|---|
| 20 | 0.20 ± 0.025 | 0.17 ± 0.05 | 0.15 | 0.22 ± 0.08 |
| 100 | 0.15 ± 0.01 | 0.19 ± 0.02 | 0.15 ± 0.01 | 0.17 ± 0.025 |
| 150 | 0.15 ± 0.01 | 0.16 ± 0.02 | 0.14 ± 0.01 | 0.18 ± 0.03 |
| 200 | 0.14 ± 0.02 | 0.16 ± 0.02 | 0.15 ± 0.01 | 0.18 ± 0.03 |
| 250 | 0.14 ± 0.02 | 0.16 ± 0.02 | 0.09 ± 0.01 | 0.15 ± 0.05 |
| 300 | 0.15 ± 0.01 | 0.15 ± 0.05 | 0.05 ± 0.01 | 0.11 ± 0.05 |
| 350 | 0.09 ± 0.015 | 0.05 ± 0.02 | 0.05 ± 0.01 | 0.12 ± 0.05 |
| 400 | 0.10 ± 0.05 | 0.05 ± 0.02 | 0.07 ± 0.02 | 0.22 ± 0.08 |
| 450 | — | — | 0.15 ± 0.05 | — |

The friction stability is good if during the measurement, the ΔCF variations of the friction coefficient are less than or equal to 0.01. The stability is moderate if ΔCF<0.02 and bad if ΔCF>0.02.

EXAMPLE 4

Composition I of Example 1 is used to improve the lubrication of bearings made up of a steel band covered with brass balls fritted and impregnated with polytetrafluoroethylene. One layer is enough to obtain a very adequate varnish after drying at 250° C. for 1 hour. By comparison, if the simple mixture A in Example 1 is used, several layers must be applied, and the resulting varnish is totally lacking in adherence.

EXAMPLE 5

Composition I of Example 1 is used to lubricate a cast aluminum device used for making agglomerated polyurethane pieces. This device is composed of a cylindrical ring in which slides a closely adjusted cylinder. Whereas mixture A of Example 1 yielded a non-adhering varnish after heating, Composition I, sprayed inside the ring and on the cylinder, yields an adhering and lubricating varnish.

EXAMPLE 6

This example shows that the varnishes of the invention can be used to lubricate pieces subject to very high temperatures.

Composition I in Example 1 is sprayed on refractory steel pieces used in a brazing plant and required to support temperatures of 500° to 600° C. and brazing spatterings. After drying, Composition I yields an adhering varnish very resistant to the severe conditions in which it was used.

EXAMPLE 7

Mixture A of Example 1 is applied on a piece of tungsten carbide which had a mirror polish making it very difficult to attach varnishes, and it was noted that the varnish was totally non-adhering. Composition I of Example 1, on the other hand, yields a varnish with good adhering properties.

We claim:

1. A process for preparing graphite fluoride lubricating varnishes which comprises (a) mixing a graphite fluoride powder with glycerine, (b) separately forming an aqueous dispersion of graphite fluoride with a salt of a condensate of naphthalene sulfonic acid and formol and then (c) intermixing (a) and (b) to form an aqueous dispersion in which the total amount of graphite fluoride and glycerine is in a weight ratio of between about 0.3 to 1 and the condensate is present in a sufficient amount to stabilize the dispersion.

2. The process according to claim 1 in which the mixture of graphite fluoride powder and glycerine (a) is within the ratio of 2 to 1.

3. The process according to claims 1 or 2 in which the graphite fluoride powder has a particle size between about 1 and 5 micrometers.

4. The process according to claims 1 or 2 in which the aqueous dispersion of graphite fluoride contains 5 to 50% by weight of graphite fluoride.

5. The process according to claims 1 or 2 in which the graphite fluoride particles in the aqueous dispersion have a particle size of approximately 1 micrometer.

6. The process according to claims 1 or 2 in which the aqueous dispersion of graphite fluoride contains 5 to 15% by weight of the sodium salt of a condensate of naphthalene sulfonic acid with formol.

7. An aqueous graphite fluoride lubricating composition comprising a graphite fluoride powder and glycerine having a total graphite fluoride/glycerine ratio of between about 0.3 to 1 and a salt of a condensate of naphthalene sulfonic acid and formol in a sufficient amount to stabilize the composition.

8. The composition of claim 7 in which the graphite fluoride/glycerine ratio is within the ratio of about 2 to 1.

9. The process for the application of lubricating compositions according to claims 7 or 8 in which the compositions of claims 7 or 8 are spread or sprayed on the metal to be coated and heated for about one hour at a temperature of approximately 250° C.

* * * * *

UNITED STATES PATENT AND TRADEMARK OFFICE

CERTIFICATE OF CORRECTION

PATENT NO. : 4,354,948

DATED : October 19, 1982

INVENTOR(S) : Elisabeth Schoch and Michel Rebiffe

It is certified that error appears in the above—identified patent and that said Letters Patent is hereby corrected as shown below:

Column 3, line 9, reads "100 parts", should read --10 parts--.

Signed and Sealed this

*Eleventh* Day of *January 1983*

[SEAL]

*Attest:*

GERALD J. MOSSINGHOFF

*Attesting Officer*

*Commissioner of Patents and Trademarks*